US006910690B1

(12) United States Patent
Pollock et al.

(10) Patent No.: US 6,910,690 B1
(45) Date of Patent: Jun. 28, 2005

(54) POSITIVE CONTROL LOWER FOLDER

(75) Inventors: David Clarke Pollock, Somersworth, NH (US); Matthew Thomas Sharkady, Portsmouth, NH (US); Paul Emmett Bredenberg, Portsmouth, NH (US); Kevin Lauren Cote, Durham, NH (US); Richard Daniel Curley, Dover, NH (US); John Marshall Gaffney, Kittery Point, ME (US)

(73) Assignee: Goss International Americas, Inc., Dover, NH (US)

( * ) Notice: Subject to any disclaimer, the term of this patent is extended or adjusted under 35 U.S.C. 154(b) by 894 days.

(21) Appl. No.: 09/348,155

(22) Filed: Jul. 6, 1999

(51) Int. Cl.[7] ..... B65H 5/02

(52) U.S. Cl. ..... 271/272; 271/302; 271/360; 271/279; 271/283

(58) Field of Search ..... 271/272, 360, 271/302, 379, 283, 182

(56) References Cited

U.S. PATENT DOCUMENTS 3,841,625 A * 10/1974 Carricato ..... 271/182
4,378,734 A 4/1983 Wirz
4,534,552 A * 8/1985 Rahe ..... 271/279
5,452,886 A 9/1995 Cote et al.
5,560,599 A 10/1996 Curley et al.
5,727,783 A 3/1998 Tassinari
5,740,900 A 4/1998 Cote et al.
5,927,712 A * 7/1999 Curley et al. ..... 271/277

FOREIGN PATENT DOCUMENTS

JP 05 147 822 6/1993

* cited by examiner

*Primary Examiner*—Donald P. Walsh
*Assistant Examiner*—Jonathan R Miller
(74) *Attorney, Agent, or Firm*—Laurence A. Greenberg; Werner H. Stemer; Ralph E. Locher

(57) ABSTRACT

A positive control signature transferring assembly, for use in a lower folder, transports and diverts signatures under positive control. The assembly has a first positive control deceleration device having grippers for transporting some of the signatures of a stream of signatures to a first delivery stream. The assembly has a gripper cylinder containing a plurality of grippers for gripping a leading edge and a trailing edge of each of the remaining signatures in the signature stream for transporting the signatures on the gripper cylinder. A second positive control deceleration device has grippers for transporting the remaining signatures released by the gripper cylinder to a second delivery stream. In this manner, the signatures are positively controlled at all times and alignment and fixed pitch errors are significantly reduced.

8 Claims, 1 Drawing Sheet

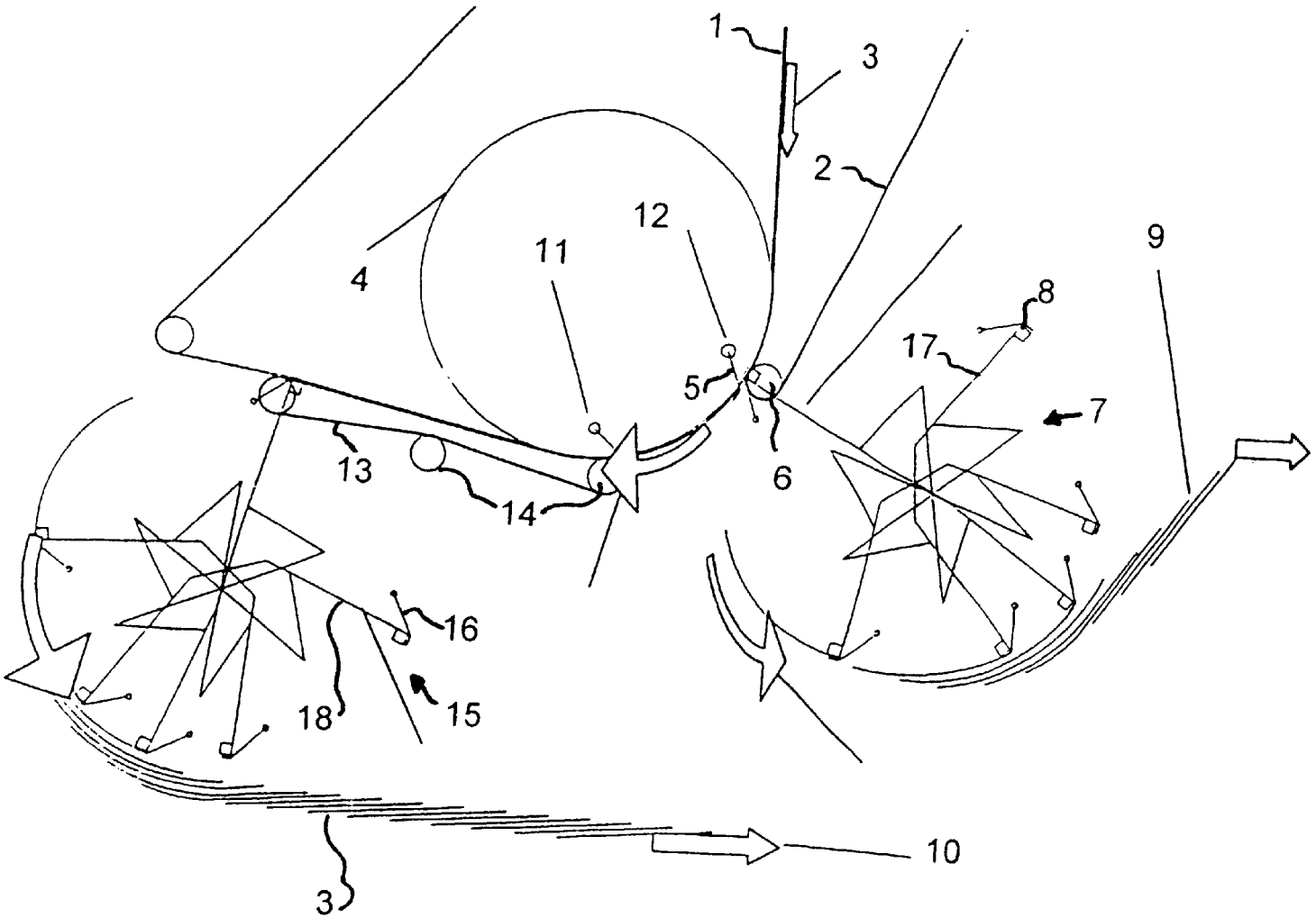
1
2
3
4
5
6
7
8
9
10
11
12
13
14
15
16
17
18
3

POSITIVE CONTROL LOWER FOLDER

BACKGROUND OF THE INVENTION

1. Field of the Invention

The invention lies in the signature transport and printing fields. Specifically, the invention relates to a positive control transport assembly such as used in a lower folder of a printing press assembly which positively controls a signature stream that is being diverted into two or more signature conveying streams.

A stream of printed products may be transported by a commonly known gripper conveyor. It is often desirable to split the common method of splitting a stream of products is to drag the initial stream over a vacuum belt traveling slower than the conveying system and to release every other signature from the gripper conveyor as soon as the respective signature contacts the vacuum belt. However, once the sheets are released their placement onto the vacuum belt fall according to a distributed pattern and the exact placement of the signature on the belt is not known. Consequently, correct alignment and a fixed pitch (a distance between the leading edge of two consecutive signatures in a product stream) of the signatures delivered to the vacuum belt cannot be guaranteed.

2. Description of the Related Art

U.S. Pat. No. 5,740,900 to Cote et al., for instance, describes an apparatus for splitting a product stream that includes a single conveying belt having a plurality of grippers traveling along a single conveyor path into two product streams. At least one of the grippers is capable of rotating a held signature from one side of the belt to the other side, so as to create a second parallel product stream. In this manner a single conveying belt forms two side by side product streams and at all times maintains positive control over the signatures. In this device the signatures are never released such as onto a vacuum belt that leads to the above mentioned distortions or pitch problems.

U.S. Pat. No. 5,560,599 to Curley et al. describes a deceleration device for slowing down signatures being transported in a folding machine. The deceleration device has a deceleration drum provided with a plurality of rotary grippers that positively grip an edge of the signatures exiting a tape conveyor system in the folding machine traveling at a high velocity. The grippers and drum decelerate the signatures before releasing them over a delivery stack.

SUMMARY OF THE INVENTION

It is accordingly an object of the invention to provide a positive control lower folder, which overcomes the above-mentioned disadvantages of the heretofore-known devices and methods of this general type, in which the signature is positively controlled while being transferred to one of a plurality of transport paths.

With the foregoing and other objects in view there is provided, in accordance with the invention, a positive control signature transferring assembly, containing:

a first positive control deceleration device having grippers for transporting some signatures of a stream of signatures to a first delivery stream;

a gripper cylinder containing a plurality of grippers for gripping a trailing edge and a leading edge of remaining signatures in the signature stream for transporting the remaining signatures on the gripper cylinder; and a second positive control deceleration device having grippers for transporting the remaining signatures released by the gripper cylinder to a second delivery stream.

In accordance with an added feature of the invention, there further contains: a first high-speed tape deflected around the gripper cylinder; a deflection roller; and a second high-speed tape deflected around the deflection roller, the signatures being transported to one of the first positive control deceleration device and the gripper cylinder between the first high-speed tape and the second high-speed tape.

In accordance with an additional feature of the invention, the first positive control deceleration device and the second positive control deceleration device each have rotatable arms holding the grippers for gripping and decelerating the signatures.

In accordance with another feature of the invention, there are further deflection rollers, and a third high-speed tape deflected around the further deflection rollers, the remaining signatures being transported between the first high-speed tape and the third high-speed tape from the gripper cylinder to the second positive control deceleration device.

In accordance with a further added feature of the invention, the first positive control deceleration device and the second positive control deceleration device are deceleration drums.

With the foregoing and other objects in view there is further provided, in accordance with the invention, a method for positively controlling and diverting signatures, which includes:

removing a batch of signatures from a signature stream with a first positive control deceleration device that grips and transports the batch of signatures to a first delivery stream, the signatures being positively controlled in their delivery to the first delivery stream;

transporting remaining signatures of the signature stream on a gripper cylinder having grippers gripping both a leading edge and a trailing edge of each of the signatures; and removing the remaining signatures from the signature stream released by the gripper cylinder with a second positive control deceleration device gripping and transporting the remaining signatures to a second delivery stream, the signatures being positively controlled in their delivery to the second delivery stream.

In accordance with an added feature of the invention, there is the step of delivering the signatures to the first positive control deceleration device between a first high-speed tape and a second high-speed tape.

In accordance with a concomitant feature of the invention, there is the step of delivering the signatures to the second positive control deceleration device between the first high-speed tape and a third high-speed tape.

Other features which are considered as characteristic for the invention are set forth in the appended claims.

Although the invention is illustrated and described herein as embodied in a positive control lower folder, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

The single FIGURE of the drawing is a diagrammatic, side-elevational view of a positive control lower folder according to the invention.

DESCRIPTION OF THE PREFERRED EMBODIMENTS

Referring now to the single figure of the drawing in detail, there is shown a first high-speed tape 1 and a second high speed tape 2 enclosing a stream of signatures 3 therebetween. The first high-speed tape 1 is deflected around or in the vicinity of a gripper cylinder 4 having a plurality of grippers 5 disposed thereon. The second high-speed tape 2 is deflected around a deflection roller 6.

A first positive control deceleration device 7 such as a deceleration drum containing a plurality of arms 17 having rotatable grippers 8 is provided for gripping the sheets 3 as they are released from in-between the high-speed tapes 1, 2. The grippers 8 grab an edge of the sheets 3 and decelerate the sheets 3. The sheets 3 are diverted to a first delivery stream 9 in which the sheets are positively controlled while being delivered to the first delivery stream 9. In this manner, the placement of the sheet 3 in the first delivery stream 9 is guaranteed.

Should the sheets 3 be intended to be delivered to a second delivery stream 10, the sheets 3 are engaged at both a leading edge 11 and a trailing edge 12 by two of the grippers 5 disposed on the gripper cylinder 4 and carried through a divert area.

A third high-speed tape 13 deflected around its deflection rollers 14 receives the sheets 3 delivered by the gripper cylinder 4. The sheets 3 are transported between the first and third high-speed tapes 1, 13.

A second positive control deceleration device 15 such as a deceleration drum containing a plurality of arms 18 having rotatable grippers 16 is provided for gripping the sheets 3 as they are released from in-between the high-speed tapes 1, 13. The grippers 16 grab an edge of the sheets 3 and decelerate the sheets 3. The sheets 3 are diverted to the second delivery stream 10 in which the sheets 3 are positively controlled while being delivered to the second delivery stream 10. In this manner, the placement of the sheet 3 in the second delivery stream 10 is guaranteed.

The invention is shown with two positive control deceleration devices 7, 15 but could contain any number of positive control deceleration devices depending on the number of diversion paths desired.

We claim:

1. A positive control signature transferring assembly, comprising:

a first positive control deceleration device having grippers for transporting some signatures of a stream of signatures to a first delivery stream;

a gripper cylinder containing a plurality of grippers for gripping a trailing edge and a leading edge of remaining signatures in the signature stream for transporting the remaining signatures on said gripper cylinder; and a second positive control deceleration device having grippers for transporting the remaining signatures released by said gripper cylinder to a second delivery stream.

2. The assembly according to claim 1, including:

a first high-speed tape deflected around said gripper cylinder;

a deflection roller; and a second high-speed tape deflected around said deflection roller, the signatures being transported to one of said first positive control deceleration device and said gripper cylinder between said first high-speed tape and said second high-speed tape.

3. The assembly according to claim 1, wherein said first positive control deceleration device and said second positive control deceleration device each have rotatable arms holding said grippers for gripping and decelerating the signatures.

4. The assembly according to claim 2; including:

further deflection rollers; and a third high-speed tape deflected around said further deflection rollers, the remaining signatures being transported between said first high-speed tape and said third high-speed tape, from said gripper cylinder to said second positive control deceleration device.

5. The assembly according to claim 1, wherein said first positive control deceleration device, and said second positive control deceleration device are deceleration drums.

6. A method for positively controlling and diverting signatures, which comprises:

removing a batch of signatures from a signature stream with a first positive control deceleration device that grips and transports the batch of signatures to a first delivery stream, the signatures being positively controlled in their delivery to the first delivery stream;

transporting remaining signatures of the signature stream on a gripper cylinder having grippers gripping both a leading edge and a trailing edge of each of the remaining signatures; and removing the remaining signatures from the signature stream released by the gripper cylinder with a second positive control deceleration device gripping and transporting the remaining signatures to a second delivery stream, the signatures being positively controlled in their delivery to the second delivery stream.

7. The method according to claim 6, which comprises delivering the signatures to the first positive control deceleration device between a first high-speed tape and a second high-speed tape.

8. The method according to claim 7, which comprises delivering the signatures to the second positive control deceleration device between the first high-speed-tape and a third high-speed tape.

* * * * *